United States Patent [19]

Looney et al.

[11] Patent Number: 4,553,592

[45] Date of Patent: Nov. 19, 1985

[54] METHOD OF PROTECTING AN RF APPLICATOR

[75] Inventors: Mark D. Looney, Missouri City; Kerry D. Savage, Houston, both of Tex.

[73] Assignee: Texaco Inc., White Plains, N.Y.

[21] Appl. No.: 578,453

[22] Filed: Feb. 9, 1984

[51] Int. Cl.[4] ..... E21B 36/04

[52] U.S. Cl. ..... 166/248; 166/57; 166/302; 166/65.1

[58] Field of Search ..... 166/248, 242, 60, 276, 166/287, 57; 285/47; 138/149, 175

[56] References Cited

U.S. PATENT DOCUMENTS

| | | | |
|---|---|---|---|
| 731,742 | 6/1903 | Beaumont | 166/242 |
| 3,095,041 | 6/1963 | Rasmussen | 166/242 |
| 3,547,193 | 12/1970 | Gill | 166/60 |
| 3,782,465 | 1/1974 | Bell et al. | 166/248 |
| 3,878,312 | 4/1975 | Bergh et al. | 166/248 |
| 3,885,595 | 5/1975 | Gibson et al. | 285/47 |
| 4,013,538 | 3/1977 | Schneider et al. | 166/248 |
| 4,037,655 | 7/1977 | Carpenter | 166/248 |
| 4,071,278 | 1/1978 | Carpenter et al. | 166/248 |
| 4,127,173 | 11/1978 | Watkins et al. | 166/276 |
| 4,135,579 | 1/1979 | Rowland et al. | 166/248 |
| 4,140,179 | 2/1979 | Kasevich et al. | 166/248 |
| 4,398,597 | 8/1983 | Habermann | 166/248 |

*Primary Examiner*—Stephen J. Novosad
*Assistant Examiner*—Bruce M. Kisliuk
*Attorney, Agent, or Firm*—Robert A. Kulason; James J. O'Loughlin; Ronald G. Gillespie

[57] ABSTRACT

A method which protects an RF applicator during the in-situ RF retorting of a hydrocarbon stratum from a borehole which traverses the hydrocarbon stratum including lining that portion of the borehole traversing the hydrocarbon stratum with a non-conductive high temperature material.

19 Claims, 2 Drawing Figures

METHOD OF PROTECTING AN RF APPLICATOR

BACKGROUND OF THE INVENTION

Field of the Invention

The present invention relates to hydrocarbon producing methods in general and, more particularly, to the insitu RF retorting of a hydrocarbon stratum.

SUMMARY OF THE INVENTION

A method which protects an RF applicator during the in-situ RF retorting of a hydrocarbon stratum from a borehole which traverses the hydrocarbon stratum including lining that portion of the borehole traversing the hydrocarbon stratum with a non-conductive high temperature material.

The objects and advantages of the invention will appear more fully hereinafter from a consideration of the detailed description which follows, taken together with the accompanying drawings, wherein two embodiments of the invention are illustrated by way of example. It is to be expressly understood, however, that the drawings are for illustration purposes only and are not to be construed as defining the limits of the invention.

DESCRIPTION OF THE INVENTION

In the in-situ radio frequency retorting, with an RF applicator, of oil shale or other hydrocarbon material, a problem is encountered in that as the oil shale heats up it expands to such an extent it damages the RF applicator. The present invention provides a method of preventing the oil shale from expanding and damaging or capturing the RF applicator.

Figure 1:
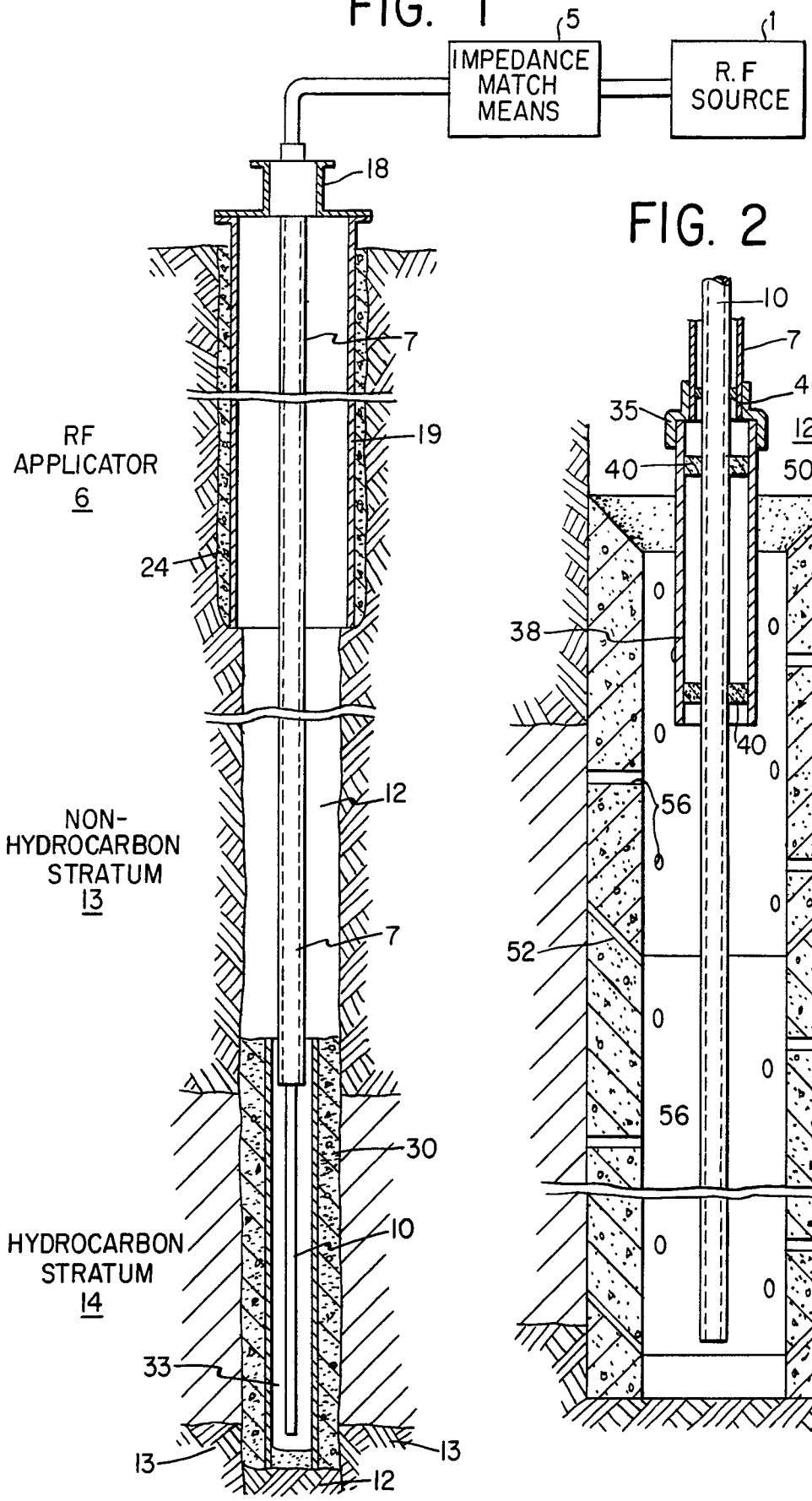
FIG. 1 shows the configuration for the RF retorting of a hydrocarbon stratum done in accordance with the present invention.

With regards to FIG. 1, a conventional type system fo RF retorting of oil shale includes a source 1 of energy which is provided at an RF frequency. The RF energy is provided to an impedance matching means 5 which matches the impedance of an RF applicator 6. RF applicator 6 includes an outer conductor 7 and an inner conductor 10 which extends beyond outer conductor and it is that extended portion of inner conductor 10 which radiates the RF energy into the hydrocarbon stratum.

Applicator 6 is maintained in a borehole 12, by a well head 18 and casing 19. Borehole 12 traverses an earth formation having non-hydrocarbon strata 13 and a hydrocarbon stratum 14. Casing 19 is cemented in place with cement 24. To protect applicator 6 from the expansion of the earth formation in the vicinity of hydrocarbon stratum 14, prior to the insertion of the aforementioned elements into borehole 12, a metal casing (not shown) is centrally positioned at the bottom of borehole 12 and has sufficient height to extend above hydrocarbon stratum 14. The outer surface of the metal casing (not shown) is coated with Teflon or other suitable material to faclitate its removal as hereinafter explained. A slurry mix of high temperature refractory material is then poured between the casing (not shown) and the earth formation which would include the hydrocarbon stratum 14. This cementing material could be a geothermal type cement, a refractory material, resin coated gravel or any similar material. Resin coated gravel is permeable and would not have to be perforated. After the cementing material has set, the metal casing (not shown) is removed, as facilitated by the Teflon. If removal is difficult, the casing (not shown) may be heated to melt the coating of Teflon which would then facilitate its removal.

Another variation is to make beforehand a non-conductive casing to fit borehole 12. This casing may be a single piece or jointed as is standard oil field casing and would be cemented in place as above and then perforated. Although ceramic materials are preferred, plastic or fiberglass materials could also be used.

Figure 2:
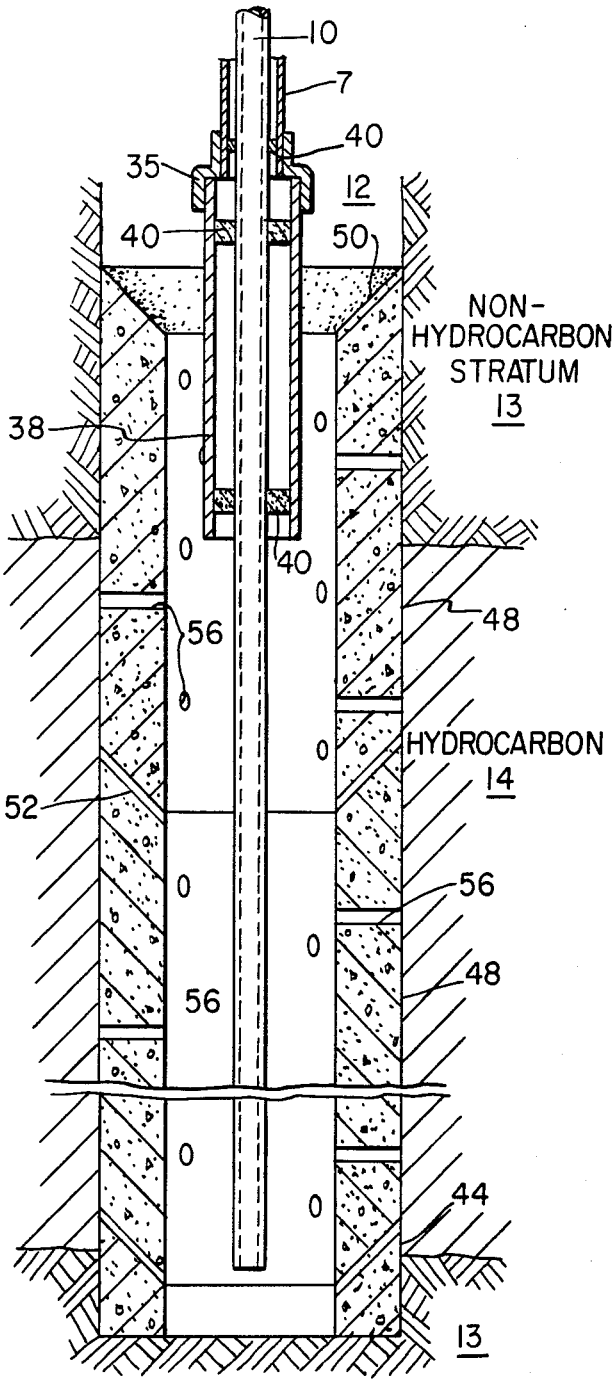
FIG. 2 is a representation of another embodiment of a method of the present invention.

Yet a better method, particularly where there would be multiple hole usage for RF applicators, would be to use multiple ceramic elements as shown in FIG. 2. A portion of applicator 6 is shown in greater detail in FIG. 2 and, although it is not necessary to the practice of the present invention, for sake of clarity this detailed portion of applicator 6 will be explained. Inner conductor 10 extends beyond outer conductor 7 traversing the hydrocarbon stratum 14 as hereinfore explained. However, outer conductor 7 in essence is flared at the end where the inner conductor 10 emerges to enhance the radiation of the electromagnetic energy into hydrocarbon stratum 14. This flaring is accomplished by an adapter 35 which, in effect, attaches a wider diameter conductive skirt 38. Non-conductive spacers 40 maintain spatial relationship between inner conductor 10, outer conductor 7, and skirt 38.

In this embodiment of the present invention, a ceramic liner is made of a bottom liner 44 and a plurality of other liners 48. The breaks in FIG. 13 indicate that hydrocarbon stratum 14 may have different thicknesses and this will affect the number of liners 48 used.

Liners 44 and 48 are ceramic cylinders. The outer diameter and the inner diameter of liners 44 and 48 are determined by the borehole 12 diameter and the skirt 38 outer diameter, or the maximum diameter of adapter 35 depending on how far up in borehole 12 the operator wants to go with the liners 48. The important criteria are that the thickness should be sufficient to withstand the pressures resulting from expansion of the earth formation, and yet allow reasonable clearance of applicator 6.

It should be noted that each liner 48 has a concave surface 50 and a convex surface 52 to facilitate its installation and mating with other liners 48 or with bottom liner 44.

Bottom liner 44 differs from liner 48 in that one surface is essentially perpendicular to the longitudinal axis of borehole 12 or is made to conform to whatever shape borehole 12 bottom would be like, while the upper surface of liner 44 is the same as surface 50. In other words, one end of bottom liner 44 is not shaped to mate with other liners 48. Thus, one would start the installation of ceramic liner parts prior to the installation of the RF applicator by lowering bottom liner 44 into borehole 12, then successively adding liner cylinders 48 until a sufficient height has been reached.

Further, each liner 48 or bottom liner 44 may have holes 56 which allow fluids to pass from the formation into the inner cavity formed by the ceramic liner elements 44 and 48. The holes have a twofold purpose. One purpose is to release fluid or pressure buildup which may destroy the ceramic liners 44 and 48 and damage applicator 6 in borehole 12. Another purpose of such holes is to allow the applicator hole, that is the borehole in which an applicator is inserted, to be used as a producing well. When an applicator borehole is also a producing well, although it is not shown in the drawing, a producing tube may be passed down through inner tubing 10 and extend beyond it to gather fluids in the cavity formed by inner diameters of liners 44 and 48.

In the first mentioned embodiment vapor holes 56 may be made by using conventional type perforation techniques well known in the oil industry.

Although in both FIGS. 1 and 2 the present invention has been shown as starting from the bottom of the borehole, it is well within the scope of one skilled in the art to plug a borehole at any desired depth, in which case the plugging of the borehole would in effect be the bottom of the bore hole for the practice of the present invention.

The present invention as herein before described is a method for protecting an RF applicator in a borehole traversing a hydrocarbon stratum from expansion of the earth formation containing that hydrocarbon stratum, from expanding and damaging or capturing the RF applicator.

What is claimed is:

1. A method for protecting an RF applicator during the in situ RF retorting of an oil shale stratum, from a borehole traversing the oil shale stratum comprising the steps of:

lining with a liner at least that portion of the borehole traversing the oil shale stratum with a non-conductive high temperature material of sufficient thickness to protect the RF applicator from expansion of the oil shale stratum, and cementing said liner in place with a high temperature, non-conductive cementing material.

2. A method as described in claim 1 in which the lining step is done in a manner so that the material's thickness is defined by one surface abutting the borehole side and the inner surface forming at least a clearance cavity for the passage of the RF applicator.

3. A method as described in claim 2 in which the lining step includes:

inserting a casing in the borehole having an outer diameter substantially the same as the desired inner diameter of the lining and whose outer surface is coated with Teflon, mixing the material with water to form a slurry, pouring the slurry between the casing and the borehole, allowing the slurry to solidify to form the lining, and removing the casing to leave the lining in place.

4. A method as described in claim 3 further comprising the step of:

providing holes in the liner at predetermined locations to allow fluid movement through the liner.

5. A method as described in claim 4 in which the oil shale stratum is at a substantial distance from the top of the borehole bottom and further comprising the step of:

plugging the borehole just below the oil shale stratum.

6. A method as described in claim 2 in which the lining step includes:

preforming a bottom liner cylinder of the material and a plurality of liner cylinders of the material, lowering the bottom liner cylinder to the bottom of the borehole, and stacking a sufficient number of liner cylinders on top of the bottom cylinder and one another until the lining operation step is completed.

7. A method as described in claim 6 in which the bottom liner cylinder and each liner cylinder has holes for fluid movement.

8. A method as described in claim 7 in which each liner cylinder except the bottom liner cylinder has a concave end and a convex end.

9. A method as described in claim 8 in which the bottom cylinder has a relatively flat end and the other end may be either concave or convex.

10. A method as described in claim 8 in which the oil shale stratum is at a substantial distance from the borehole bottom and further comprising the step of:

plugging the borehole just below the oil shale stratum.

11. A method of retorting an oil shale stratum with an RF energy comprising the steps of:

drilling a borehole through the earth formation so as to traverse the oil shale stratum, lining the borehole in the vicinity of the hydrocarbon stratum with a non-conductive high temperature refractory material having sufficient thickness to protect an RF applicator from expansion of the oil shale stratum, inserting an RF applicator into the borehole, and energizing the RF applicator with RF energy in a manner so that the RF applicator radiates the RF energy into the oil shale stratum.

12. A method as described in claim 11 in which the lining of the borehole is done with one bottom liner cylinder and a plurality of liner cylinders, each cylinder being made of the non-conductive high temperature refractory material.

13. A method as described in claim 11 in which the material is ceramic.

14. A method as described in claim 13 in which the bottom liner cylinder has a relatively flat end and a concave or convex end.

15. A method as described in claim 14 in which each liner cylinder of the plurality of liner cylinders has a convex end and a concave end.

16. A method as described in claim 15 in which the oil shale stratum is at a substantial distance from the borehole bottom and further comprising the step of:

plugging the borehole just below the oil shale stratum.

17. Apparatus for protecting an RF applicator during the in-situ retorting of an oil shale stratum from a borehole traversing the oil shale stratum comprising:

means lining at least that portion of the borehole traversing the oil shale stratum for protecting the RF applicator from expansion of the oil shale stratum while permitting the RF applicator to provide RF energy into the oil shale stratum, and means for holding said protecting means in place.

18. Apparatus as described in claim 17 in which the protecting means is cylindrical in shape in which the inner surface forms at least a clearance cavity for the passage of the RF applicator.

19. Apparatus as described in claim 18 in which the protecting means is a plurality of cylindrical elements which are stacked one on top of the other to provide the protecting means.

* * * * *